US009658009B1

(12) United States Patent
Vankeuren, III

(10) Patent No.: US 9,658,009 B1
(45) Date of Patent: May 23, 2017

(54) BOLT HANDLE MODIFICATION SYSTEM AND METHOD

(71) Applicant: Lewis Karl Vankeuren, III, Galena, OH (US)

(72) Inventor: Lewis Karl Vankeuren, III, Galena, OH (US)

( * ) Notice: Subject to any disclaimer, the term of this patent is extended or adjusted under 35 U.S.C. 154(b) by 0 days.

(21) Appl. No.: 15/067,857

(22) Filed: Mar. 11, 2016

(51) Int. Cl.
*F41A 3/72* (2006.01)

(52) U.S. Cl.
CPC ..... *F41A 3/72* (2013.01)

(58) Field of Classification Search
CPC ..... F41A 3/72; F41A 3/22–3/24
See application file for complete search history.

(56) References Cited

U.S. PATENT DOCUMENTS 206,279 A * 7/1878 Trabue ..... F41A 9/18 42/16
1,926,816 A * 9/1933 Podrabsky ..... F41A 3/72 89/1.1
2,085,812 A * 7/1937 Loomis ..... F41A 3/22 42/16
2,181,131 A * 11/1939 Johnson, Jr. ..... F41A 3/72 42/16
2,334,798 A * 11/1943 Swebilius ..... F41A 3/72 42/16
2,454,885 A * 11/1948 Robinson, Jr. ..... F41A 3/12 42/16
3,432,955 A * 3/1969 Vartanian ..... F41A 3/72 42/16
3,979,849 A * 9/1976 Haskins ..... F41A 3/22 42/1.04
4,020,577 A 5/1977 Duffy
4,052,926 A * 10/1977 Tollinger ..... F41A 9/18 89/1.4
5,606,825 A * 3/1997 Olsen ..... F41A 3/72 42/51
5,821,445 A * 10/1998 Guhring ..... F41A 3/72 42/16
5,926,988 A * 7/1999 Casull ..... F41A 3/22 42/16
6,019,024 A * 2/2000 Robinson ..... F41A 3/72 89/1.42
6,418,655 B1 * 7/2002 Kay ..... F41A 3/46 42/70.08
6,508,025 B1 1/2003 Du Plessis
8,302,340 B1 11/2012 Irwin
8,533,986 B2 * 9/2013 Klotz ..... F41A 3/18 42/16
8,925,230 B2 1/2015 Warburton et al.
8,925,234 B1 1/2015 Barrett
9,151,553 B2 10/2015 Constant et al.
2015/0233656 A1 * 8/2015 Karagias ..... F41A 35/06 42/16

* cited by examiner

*Primary Examiner* — Stephen M Johnson
*Assistant Examiner* — Joshua Semick
(74) *Attorney, Agent, or Firm* — Ronald J. Koch

(57) ABSTRACT

A bolt action rifle bolt handle modification system and method replaces the original bolt handle with an assembly that allows use of a telescopic sight mounted on the top of the rifle. This system requires less skill and specialized equipment than existing handle modification methods.

1 Claim, 3 Drawing Sheets

BOLT HANDLE MODIFICATION SYSTEM AND METHOD

BACKGROUND AND SUMMARY

The present disclosure generally relates to firearms, and more particularly to bolt handle assemblies for bolt action rifles.

Bolt action rifles generally include a barrel, a receiver onto which the barrel is mounted, and a bolt assembly including a cylindrical breech bolt that is axially movable in a receiver for opening and closing the breech. The bolt includes locking lugs at the front end which may be rotated into a locked position at the rear of the barrel. The bolt may be manually rotated between the locked and unlocked positions while in the closed breech position and also moved axially forward or rearward via a handle that protrudes approximately laterally outwards from the bolt for grasping by the user.

Many surplus military bolt action rifles are popular with civilian shooters and hunters because of their reliability and power. One of these firearms is the Mosin-Nagant rifle. This rifle was designed with open sights and a straight bolt handle that rotates to a vertical position when open. This design prohibits mounting a telescopic sight on the top of the rifle which limits the rifle's usefulness for long range hunting and shooting. Military sniper versions of the Mosin-Nagant have a modified bolt handle that allows a scope to be attached. Custom versions of the bolt handle are also available commercially. However, these modified bolt handles are generally welded onto the original bolt body in place of the original handle. This procedure requires a high level of skill to be done satisfactorily. A need therefore exists for a method to install a modified bolt handle that requires less specialized skill and equipment.

The present invention provides such a method of attachment of a new bolt handle to the bolt body of a bolt action rifle. This method requires only cutting and drilling. Unlike other existing methods, no welding is required. The new handle is designed to allow a low profile scope mount to be installed on the top of the rifle, which is not possible with the original straight bolt handle. The preferred embodiment is for a Mosin-Nagant rifle but could be applied to other rifles that have an action of similar configuration.

REFERENCE NUMERALS IN DRAWINGS

Figure 1:
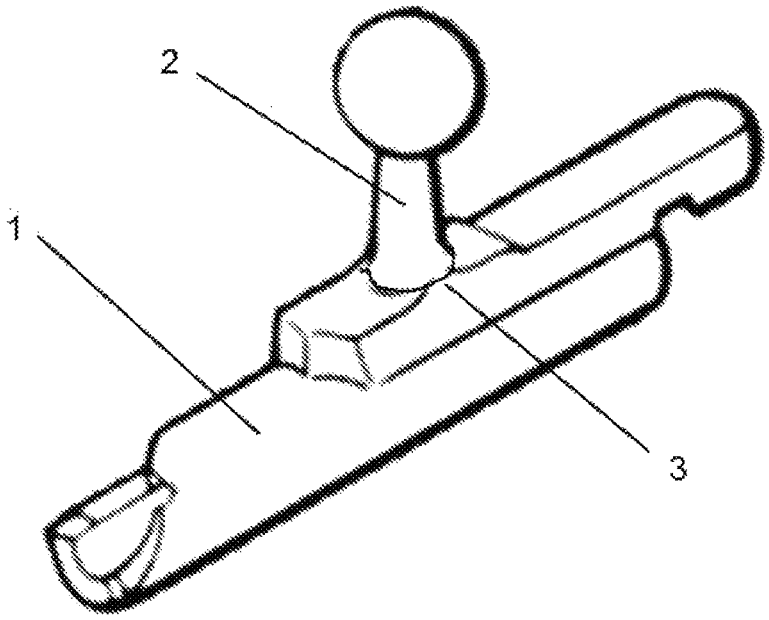
FIG. 1 shows a perspective view of one embodiment of an original bolt action rifle bolt body with a straight bolt handle.

The table below lists the reference numerals employed in the figures, and identifies the element designated by each numeral.

1 bolt body 1
2 original bolt handle 2
3 handle cut-off location 3
4 attachment hole 4
5 attachment nub 5

6 new bolt handle 6
7 tension pin hole 7
8 tension pin 8
9 proximate end 9 of new bolt handle 6
7A tension pin hole 7A

DETAILED DESCRIPTION

In one embodiment, a method for modifying a bolt handle comprises steps of: obtaining an original bolt body 1 has a bolt handle 2 attached thereto proximate a handle cutoff location 3; severing bolt handle 2 from original bolt body 1 proximate handle cutoff location 3; drilling an attachment hole 4 into original bolt body 1 proximate handle cutoff location 3; drilling a tension pin hole 7 into original bolt body 1 such that tension pin hole 7 is perpendicular and operatively connected to attachment hole 4; obtaining a new bolt handle 6 having an attachment nub 5 attached to a proximate end 9 thereof, attachment nub 5 having a tension pin hole 7A; inserting attachment nub 5 into attachment hole 4 such that tension pin hole 7A of attachment nub 5 coincides with tension pin hole 7 of original bolt body 1; and inserting a tension pin 8 through tension pin holes 7, 7A of original bolt body and attachment nub, respectively.

Tension pin 8 is adapted to frictionally fit within tension pin holes of original bolt body and attachment nub. Attachment nub 5 is substantially perpendicular to new bolt handle 6, In one embodiment, a bolt handle modification system comprises: an original bolt body 1 having a bolt handle attachment hole 4 and a tension pin hole 7; a new bolt handle 6 having a bolt handle attachment nub 5 attached to a proximate end 9 thereof, bolt handle attachment nub having a tension pin hole 7A; and a tension pin 8 adapted to frictionally fit within tension pin holes 7, 7A of original bolt body and new bolt handle, respectively.

Figure 2:
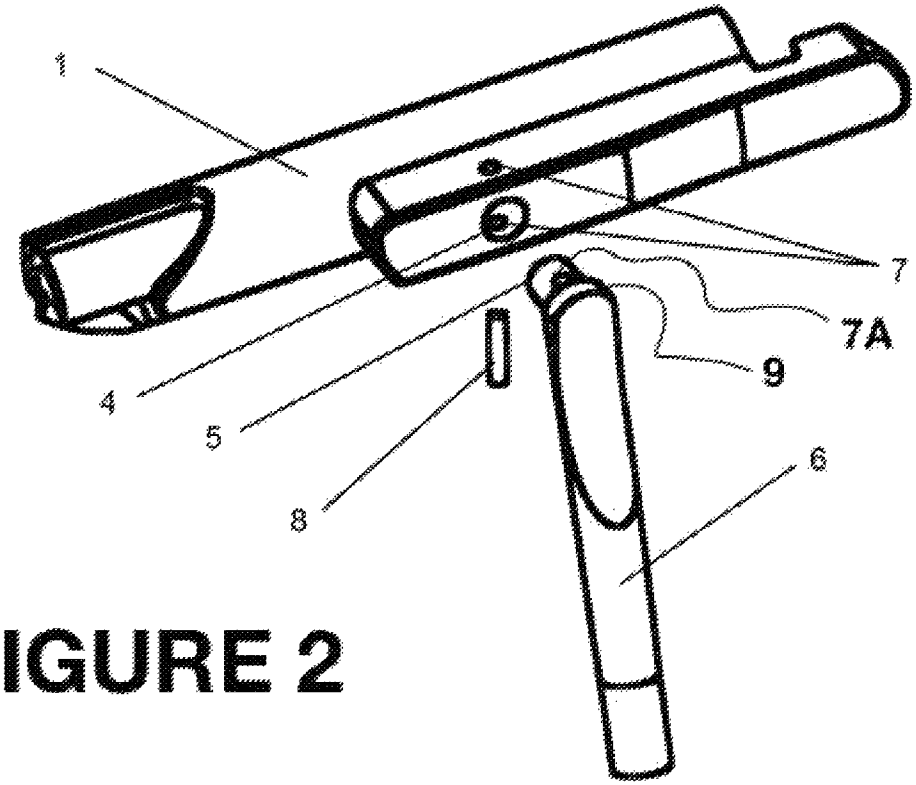
FIG. 2 shows an exploded perspective view of the modified body and new bolt handle.
Figure 3:
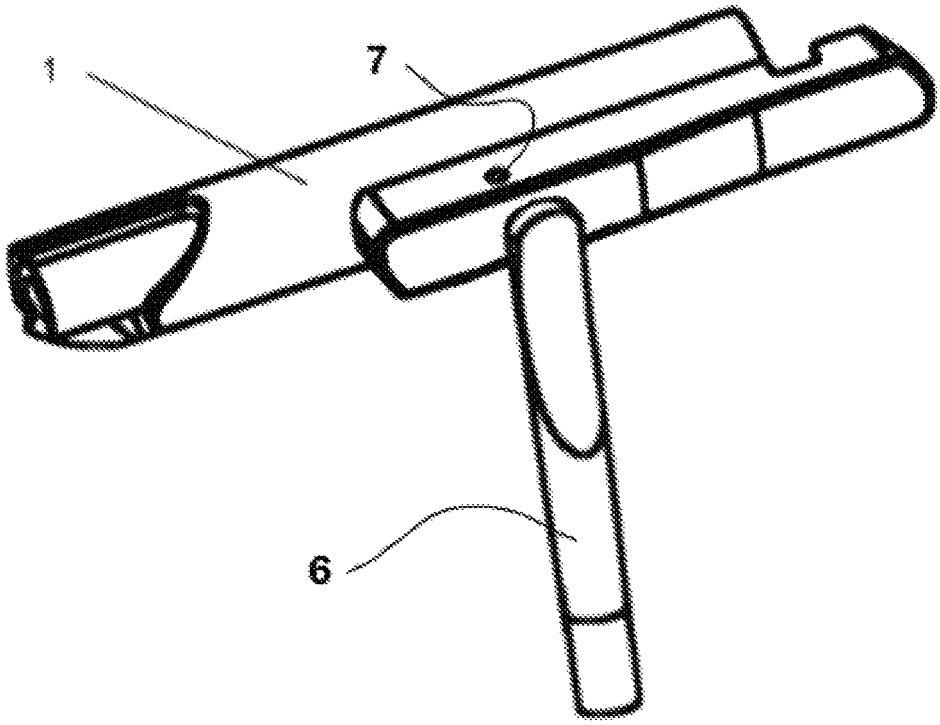
FIG. 3 shows a perspective view of the modified body and new bolt handle.

Bolt handle attachment nub 5 is substantially perpendicular to new bolt handle 6. As shown in FIGS. 2 & 3, this structure allows new bolt handle 6 to be operated without interfering with an attached scope.

Attachment nub 5 fits within bolt handle attachment hole 4 such that tension pin holes 7, 7A coincide. Tension pin 8 is positioned through tension pin holes 7, 7A. Tension pin hole 7 of original bolt body 1 is perpendicular and operatively connected to attachment hole 4 of original bolt body 1 so that tension pin holes 7, 7A coincide when attachment nub 5 is fitted within bolt handle attachment hole 4.

As shown in FIG. 2, attachment hole 4 is drilled into original bolt body 1 at approximately the same location as original bolt handle 2. Attachment hole 4 is sized to accommodate attachment nub 5 that extends from the end of the new bolt handle 6. Attachment nub 5 is inserted into attachment hole 4 completely, and a tension pin hole 7 that is oriented perpendicular to attachment hole 4 is drilled through the bolt body 1 and attachment nub 5. The new bolt handle 6 is secured into place with tension pin 8 that is driven into tension pin hole 7.

In one embodiment, tension pin hole 7 extends entirely through original bolt body 1, tension pin hole 7A extends entirely through attachment nub 5, and tension pin 8 is adapted to extend all the way through original bolt body 1.

In another embodiment, tension pin hole 7 does not extend entirely through original bolt body 1. Rather, it only extends into one side of original bolt body 1, and tension pin 8 is adapted to extend into one side of original bolt body 1, and extend entirely through attachment nub 5. This variation is substantially functionally the same but may be more aesthetically appealing to some.

What is claimed is:

1. A method for modifying a bolt handle comprising the steps of:

obtaining an original bolt body having a bolt handle attached thereto proximate a handle cutoff location;

severing the bolt handle from the original bolt body proximate the handle cutoff location;

drilling an attachment hole into the original bolt body proximate the handle cutoff location;

drilling a tension pin hole into the original bolt body such that the tension pin hole is perpendicular and operatively connected to the attachment hole;

obtaining a new bolt handle having an attachment nub attached to a proximate end thereof, the attachment nub being substantially perpendicular to the new bolt handle, the attachment nub having a tension pin hole;

inserting the attachment nub into the attachment hole such that the tension pin hole of the attachment nub coincides with the tension pin hole of the original bolt body;

inserting a tension pin through the tension pin holes of the original bolt body and the attachment nub, the tension pin being adapted to frictionally fit within the tension pin holes of the original bolt body and the attachment nub.

* * * * *